US006832961B2

(12) United States Patent
Sano

(10) Patent No.: US 6,832,961 B2
(45) Date of Patent: Dec. 21, 2004

(54) WOOD-TYPE GOLF CLUBHEAD

(75) Inventor: Yoshinori Sano, Kobe (JP)

(73) Assignee: Sumitomo Rubber Industries, Inc., Hyogo-ken (JP)

( * ) Notice: Subject to any disclaimer, the term of this patent is extended or adjusted under 35 U.S.C. 154(b) by 0 days.

(21) Appl. No.: 10/234,323

(22) Filed: Sep. 5, 2002

(65) Prior Publication Data

US 2003/0064825 A1 Apr. 3, 2003

(30) Foreign Application Priority Data

Sep. 10, 2001 (JP) ..... 2001-273918

(51) Int. Cl.[7] ..... A63B 53/04
(52) U.S. Cl. ..... 473/324; 473/349; 473/345
(58) Field of Search ..... 473/324, 345, 473/346, 329, 347, 348, 349, 350, 290, 291, 342

(56) References Cited

U.S. PATENT DOCUMENTS 4,438,931 A * 3/1984 Motomiya ..... 473/346
4,793,616 A * 12/1988 Fernandez ..... 473/347
5,024,437 A * 6/1991 Anderson ..... 473/342
5,776,011 A * 7/1998 Su et al. ..... 473/345
5,967,904 A * 10/1999 Nagai et al. ..... 473/345
6,193,614 B1 * 2/2001 Sasamoto et al. ..... 473/329
6,228,189 B1 * 5/2001 Oyama et al. ..... 148/669
6,238,301 B1 * 5/2001 Takeda ..... 473/324
6,348,013 B1 * 2/2002 Kosmatka ..... 473/329
6,354,962 B1 * 3/2002 Galloway et al. ..... 473/342
6,506,129 B2 * 1/2003 Chen ..... 473/329

FOREIGN PATENT DOCUMENTS

JP 10-179818 A 7/1998

* cited by examiner

*Primary Examiner*—Sebastiano Passaniti
(74) *Attorney, Agent, or Firm*—Birch, Stewart, Kolasch & Birch, LLP

(57) ABSTRACT

A wood-type golf club head containing a volume which is not less than 300 cc, including a main body and a face member disposed on the front of the main body to form a clubface. The face member is formed by (i) forging an alpha-beta-type titanium alloy at a temperature which is less than the transformation temperature to the beta phase of the alloy, and of which difference from the transformation temperature to the beta phase is not more than 100 deg.C., and (ii) subsequent cooling within a temperature range of from 0 to 100 deg.C. The face member is welded to the main body to form a junction therebetween, wherein the junction is partially or wholly shifted backwards from the edge of the clubface by at least 5 mm, and the total length of the edge of the clubface where the shift is at least 5 mm, is not less than 40% of the whole length of the edge.

14 Claims, 6 Drawing Sheets

WOOD-TYPE GOLF CLUBHEAD

This non-provisional application claims priority under 35 U.S.C. § 119(a) on Patent Application No. 2001-273918 filed in Japan on Sep. 10, 2001, which is herein incorporated by reference.

BACKGROUND OF THE INVENTION

1. Field of the Invention

The present invention relates to a wood-type golf club head, more particularly to the structure of the face portion thereof, which is capable of improving hit feel, rebound performance and strength in a well-balanced manner.

2. Related Art

In recent years, the wood-type metallic golf clubs have a tendency to increase the volume of the club head, and the mainstream club heads have a volume of over 300 cc.

In general, in order to increase the head volume without increasing the weight, high-strength thin metallic materials are used in various portions of the club head. In the case of using such thin materials, especially in the case of a club head composed of a main body and a face plate defining the clubface, in order to provide a sufficient strength for the weld joint between the main body and face plate, it is unavoidable that the thickness of the main body is increased in the joint portion, namely, in the portion immediately behind the face plate, along the edge thereof. However, such an increase in thickness is liable to cause a deterioration in the rebound performance. Also, the feel at the time of hitting the ball becomes solid or hard. In addition, there is the tendency for the contact sound between the club and the ball to exhibit a lower pitch as the head volume is increased, although a clear high pitch sound is generally preferred by many golfers.

SUMMARY OF THE INVENTION

It is therefore, an object of the present invention to provide a wood-type golf club head, in which hit feel, rebound, performance and strength are improved in a well-balanced manner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
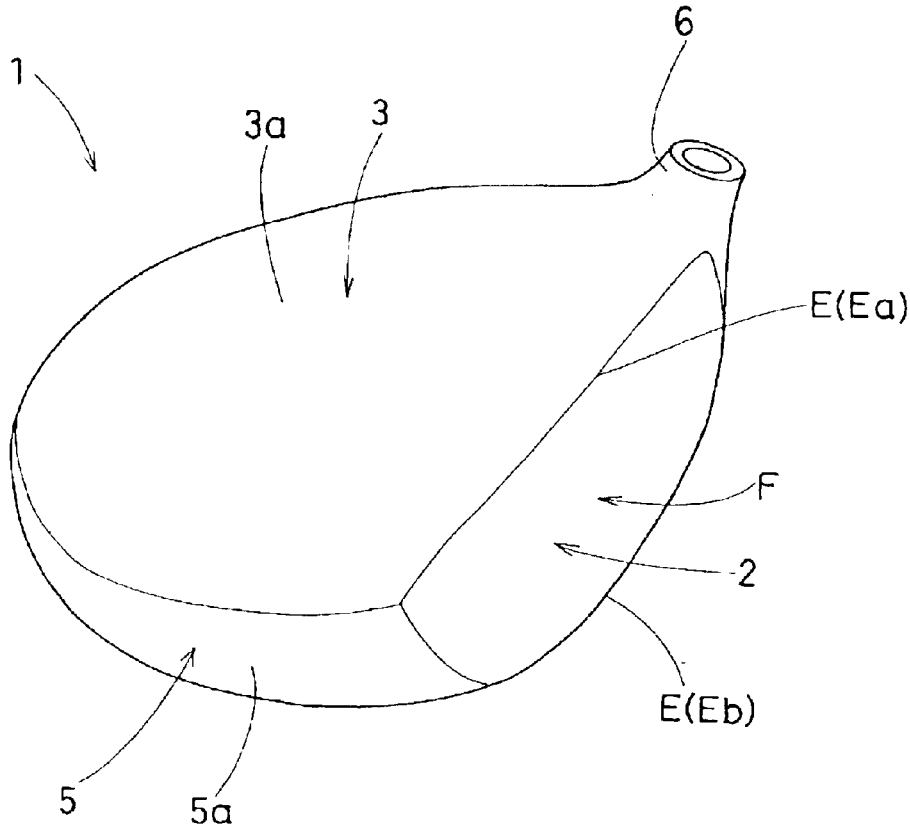
FIG. 1 is a perspective view of a club head according to the present invention.

Embodiments of the present invention will now be described in detail in conjunction with the accompanying drawings.

In the drawings, wood-type golf club head 1 according to the present invention comprises a face portion 2 defining a clubface F for hitting a ball, a crown portion 3 defining a top face of the club head, a sole portion 4 defining a bottom face of the club head or sole, a side portion 5 between the crown portion 3 and sole portion 4, extending from the toe to the heel through the back face to define a side face of the club head, and a hosel 6 having an opening for the club shaft.

The club head 1 is a hollow metal head having a head volume of not less than 300 cc (inclusive of the protruding hosel 6). Preferably, the head volume is in a range of 300 to 400 cc, more preferably 305 to 370 cc.

Definition

Figure 4:
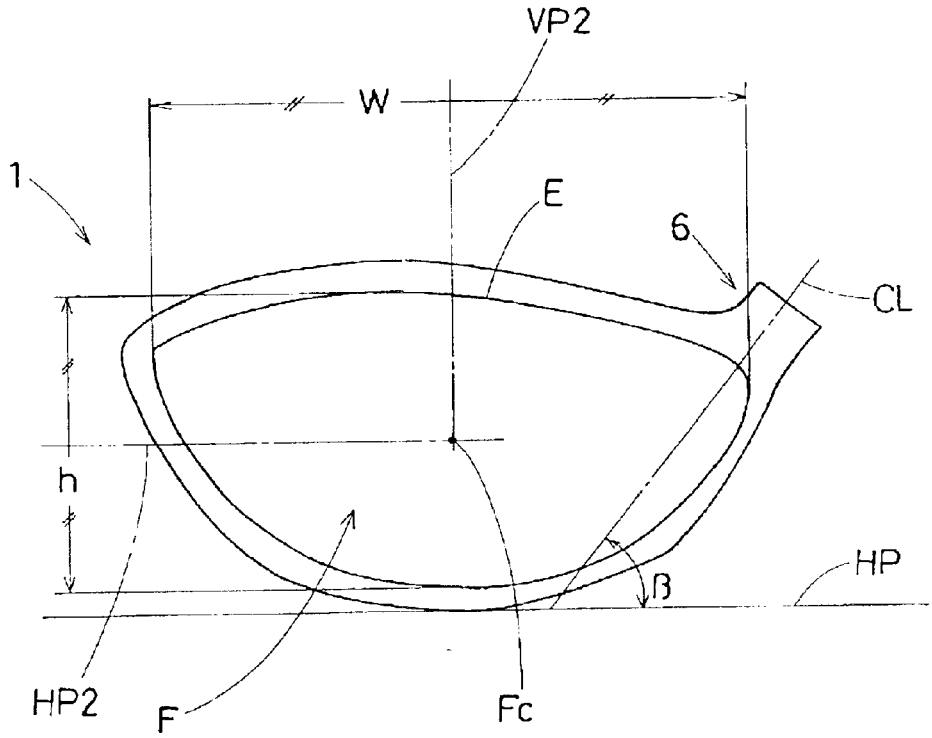
FIG. 4 is a front view of the club head.

Measuring state: The measuring state is a state of the golf club head 1 which is, as shown in FIG. 4, set on a horizontal plane HP such that the center line CL of the club shaft is inclined at the lie angle beta while keeping the center line CL on a vertical plane VP1, and the clubface F forms its loft angle with respect to the horizontal plane HP.

Sweet Spot SS:

The sweet spot is the point of intersection between the clubface F and a straight line K drawn normal to the clubface F passing the center of gravity G of the golf club head. (see FIG. 6(B))

Figure 6A:
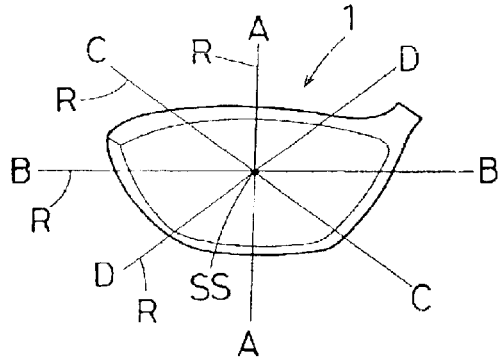
FIGS. 6(A), 6(B) and 6(C) are schematic views for explaining the edge of the clubface.
Figure 6B:
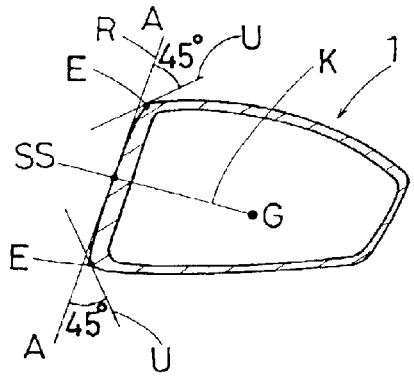
Figure 6C:
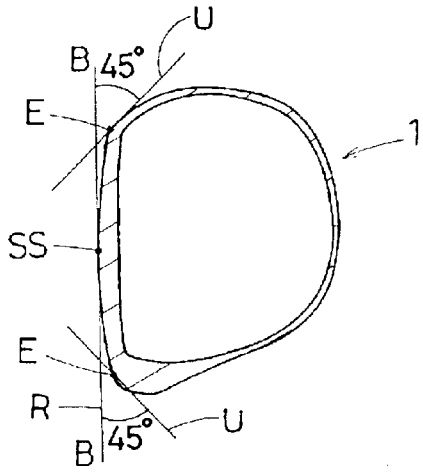

Face Edge E:

The edge of the clubface F is defined as follows: As shown in FIGS. 6(A), 6(B) and 6(C), a tangent R to the clubface F at the sweet spot SS is defined—(In FIG. 6(A), only four lines A, B, C and D are drawn, indeed, the tangent R is innumerable lines) and a straight line U is drawn backward from the tangent R wile inclining outside at an angle of 45 degrees with respect to the tangent R so that the straight line U comes into contact with the surface of the golf club head at a point, and using this contact point, the edge E is defined as the continuity of such contact point.

Face Height (h):

The face height of the face F is measured in the vertical direction between the uppermost point and the lowermost point on the face edge E. (see FIG. 4)

Face Width (w):

The face width of the face F is measured in the horizontal direction between the extreme end points on the face edge E in the horizontal direction. (see FIG. 4)

Face Center Fc:

The face center point of the face F is, as shown in FIG. 4, defined as a point of intersection of the face F, a horizontal plane HP2 at the middle of the face height (h), and a vertical plane VP2 at the middle of the face width (w).

Figure 2:
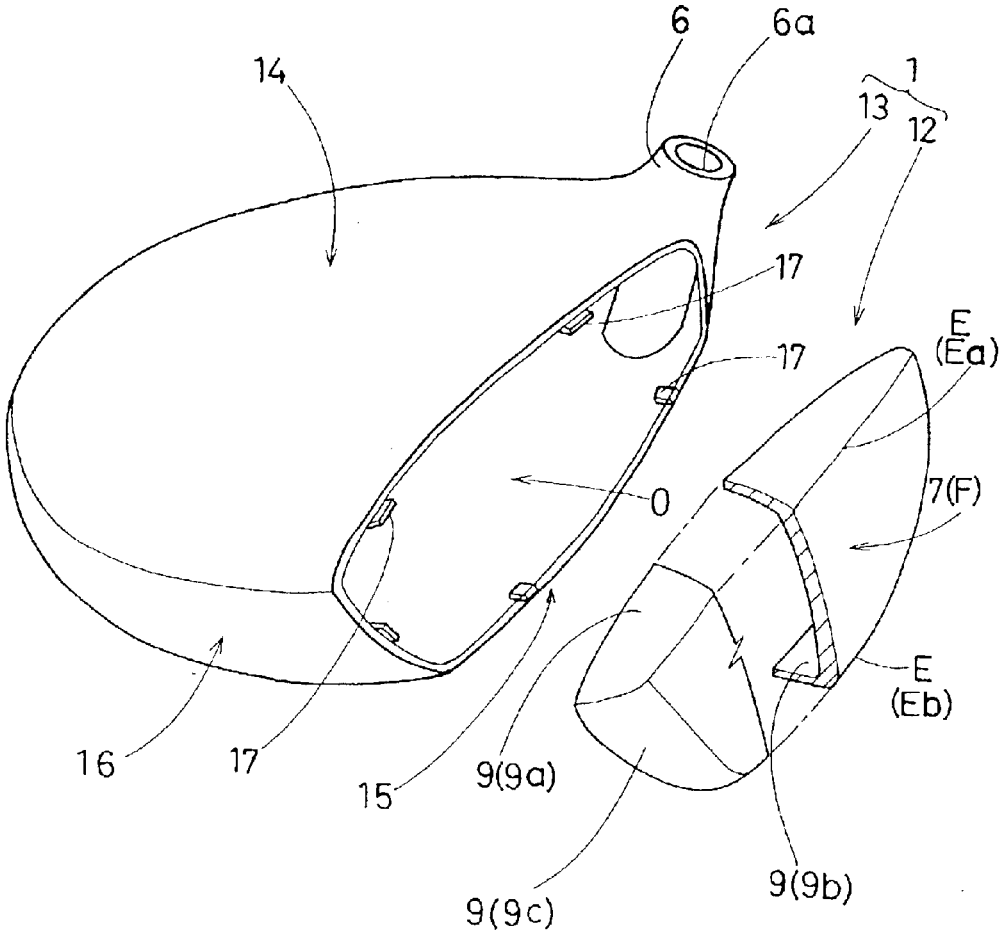
FIG. 2 is an exploded perspective view of the club head showing its two-piece structure made up of a main body and a face member.

In this embodiment, as shown in FIG. 2, the club head 1 is made up of a main body 13 and a face member 12 attached to the front of the main body 13 by welding. The club head 1, in this example, has a two-piece structure.

The main body 13 is composed of the above-mentioned hosel 6, a portion 14 forming a major part of the crown portion 3 (hereinafter, the "crown major part 14"), a part 15 forming a major part of the sole portion 4 (hereinafter, the "sole major part 15"), and a side major part 16 extending from the crown major part 14 to the sole major part 15. All of these parts are integrally molded, forming an opening O at the front of the main body 13. The opening O closed by the attached face member 12. For the purpose of positioning and temporarily fixing the face member 12 during welding, the main body 13 is provided inside the opening O with hooks 17 along the edge of the opening O.

The hosel 6 is provided with a circular hole 6*a* for inserting the club shaft which extends towards the inside of the main body 13 from the above-mentioned opening O. The center line of the hole 6*a* can be used instead of the center line CL of the golf club shaft when setting up the golf club head 1 alone at the lie angle beta The main body 13 in this example is an integral molding of an alpha-beta-type titanium alloy (Ti-6Al-4V) formed by lost-wax precision casting. However, the main body 13 may be made of various metallic materials such as aluminum alloy, pure titanium, titanium alloy, stainless steel and the like. Further, the main body 13 may be formed by various methods, for example, welding two or more parts into one body.

The face member 12 is composed of a flat main portion 7 of which the outer surface defines the clubface F, and an extended wall part 9 which extends backward from the face edge E.

The extended wall part 9 in this example includes a part 9*a* forming the remaining minor part of the crown portion 3, a part 9*b* forming the remaining minor part of the sole portion 4, and a part 9*c* forming the remaining minor part of the side portion 5.

The extended wall part 9 supports the main portion 7 at a certain distance from the front of the main body 13 while forming a hollow behind the entirety of the face portion 2.

The face member 12 is made of an alpha-beta-type titanium alloy. And the main portion 7 and extended wall part 9 are integrally formed by hot forging. Advantageously, Ti-6Al-4V(6-4 titanium), Ti-4.5Al-3V-2Fe2Mo(SP700), Ti-3Al-2.5V and the like can be used as the material of the alpha-beta-type titanium alloy. Especially, the first two alloys are preferable.

The forging temperature of the alloy is set to be less than the transformation temperature to the beta phase of the material alloy. Further, the difference of the forging temperature from the transformation temperature is set to be not more than 100° C., preferably not more than 90° C., more preferably not more than 80° C., less than the transformation temperature.

In case of beta-type titanium alloy, a relatively high temperature is required during hot forging. This is especially true in the deep face member 12 having the above-mentioned extended wall part 9. The alloy tends to have a needle crystal structure and a coarsen crystal structure. As a result, its strength and toughness tends to decrease.

In the case of an alpha-type titanium alloy or pure titanium, as the tensile strength is lowered, it is difficult to make the face member 12 capable of withstanding the impulsive force created at the time of hitting the ball.

The above-mentioned hot forging is conducted, putting the material in an oven. Thereafter, the face member 12 is removed from the oven, and air cooling, without a blower, is conducted within a temperature range of from 0 to 100° C., preferably from 10 to 50° C.

If a slower cooling is employed, the hardness increases and the hit feel deteriorates. If rapid cooling such as water-cooling is employed, the residual stress due to the forging becomes large and deformation tends to occur during welding, which makes the finished shape unstable.

Through hot forging and subsequent cooling, the Vickers hardness of the clubface F is set in a range of from 300 to 380 Hv, preferably 310 to 360 Hv, more preferably 315 to 350 Hv. As to the measuring conditions and method, see the under mentioned "Vickers Hardness Test".

If the Vickers hardness is more than 380 Hv, the hit feel becomes too hard. If less than 300 Hv, the hit feel becomes too soft. Further, the resistance to external injury decreases.

As to the above-mentioned hot forging, for example, free forging, open/closed/semi-closed die forging, high speed forging, isothermal forging, and the like, may be employed as far as it can cause plastic deformation. But, closed die forging is preferable because the surface of the material does not tend to form a hard oxide film (scale).

In any case, the alpha-beta-type titanium alloy shaped into a plate, round bar or the like is heated to the above-mentioned forging temperature, and the material is shaped into the face member 12 by striking with a hammer or pressing with a die, whereby, in comparison with casting, compact crystal structure can be obtained and the strength of the material is improved.

Especially, by setting the forging temperature as above, the ductility of the titanium alloy is increased and the workability may be improved.

By the above-mentioned hot forging and cooling, the hardness of the clubface can be optimized and thereby hit feel, resistance to breakage, finish shape stability may be improved.

If forging is made at a temperature which is not less than the transformation temperature to the beta phase, all the crystal formed become beta phase. Thereafter, as the beta crystal is cooled, alpha crystal needles separate out. As a result, a crack becomes liable to expand with easy. The fatigue resistance deteriorates, and further brittle fracture becomes liable to occur. Thus, the strength of the face member 12 becomes insufficient.

If the temperature difference is more than 100° C., less than the transformation temperature, as the work temperature is low, the plastic forming becomes difficult, and fatigue and wear of the die and other tools increase. Further, the production efficiency is liable to be reduced.

As described above, the face member 12 is welded to the main body 13. Specifically, the wall parts 9*a*, 9*b* and 9*c* of the face member 12 are welded to the major parts 14, 15 and 16 of the main body 13, respectively.

The weld junction (j) between the face member 12 and main body 13 is disposed apart from the face edge E by a distance D of at least 5 mm.

Therefore, the rigidity of the clubface F near the edge E can be prevented from increasing, and thereby a certain type of vibration of the clubface F, which is caused at the time of hitting the ball and is effective in the rebounding action of the golf ball, can be promoted. The impulsive force at the time of hitting the ball transmitted to the junction 0) from the clubface F can be dispersed and mitigated by the extended wall part 9. Thus, the strength of the club head can be increased.

In the junction (j), the weld bead remains on the inside of the club head more or less and increases the thickness. Thus, the rigidity increases in this part. On the other hand, as the junction (j) is subjected to a high temperature during welding, coarsening of the crystal and/or transformation into needles are more or less caused and again the hardness is increased. Therefore, if such junction (j) is located near the edge E of the clubface F, the rebound performance deteriorates. Further, the strength tends to decrease.

On the other hand, if the junction (j) is formed at or near the face edge E and the head volume is increased to over 300 cc, the hitting sound generally becomes worse.

Therefore, the distance D is set in a range of not less than 5 mm, more preferably not less than 8 mm, still more preferably not less than 15 mm. Further, the distance D is set to be at most 50 mm, preferably less than 30 mm, more preferably less than 20 mm.

If the distance D is less than 5 mm, it is difficult to improve the rebound performance, strength and feel in a well balanced manner.

Here, the distance D is measured from the face edge E to the junction (j) in a direction normal to the above-mentioned vertical plane VP1, namely, in the back-and-forth direction of the club head under the measuring state.

Figure 5:
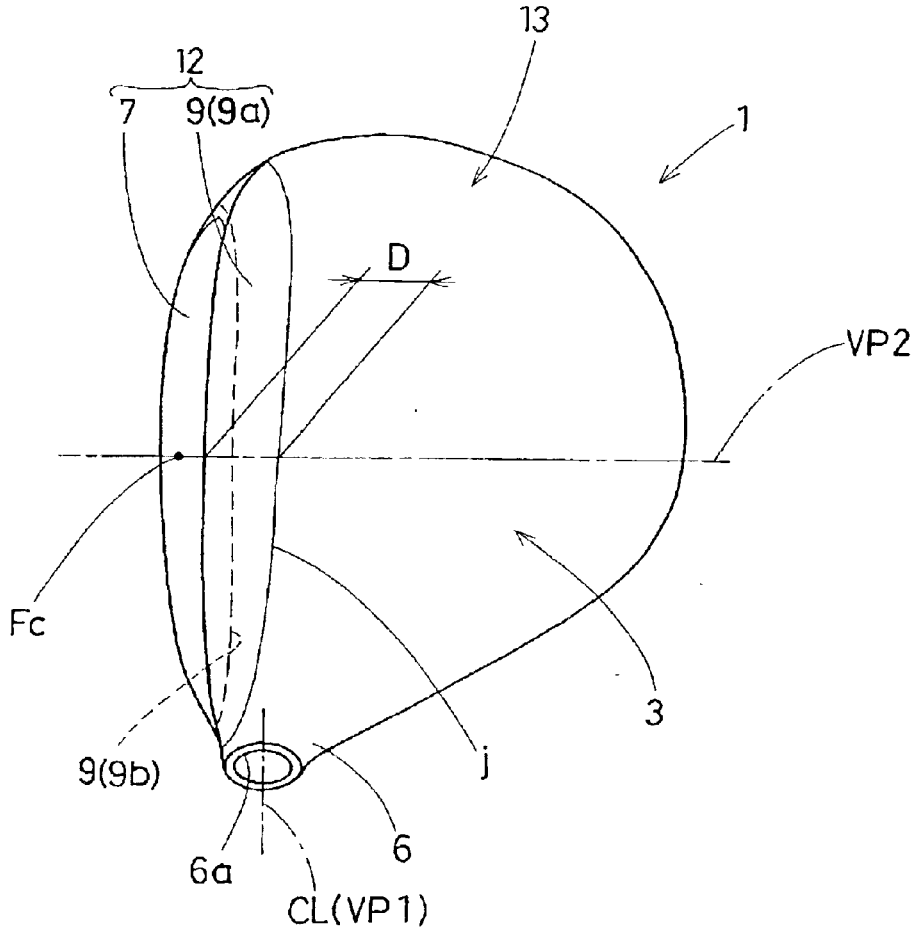
FIG. 5 is a top view of the club head.

Although it is desirable that a distance D of more than 5 mm is provided to the entire length of the face edge E, this is not always possible if for example the hosel 6 is formed near the clubface F as in this example (see FIG. 5).

However, a definite result can be obtained if 40% of the total length of the face edge E defines a distance D of more than 5 mm. Advantageously, the total length is preferably more than 40%, more preferably more than 50%, and still more preferably more than 60%.

It is thus, not always necessary that the extended wall part 9 is provided along the entire length of the face edge E.

The extended wall part 9 may be formed as including one or two of the above-mentioned parts 9*a,* 9*b* and 9*c,* for example the part 9*a* only or the part 9*b* only. Further, it may be possible that the extended wall part 9 includes a part forming a minor front end part of the side portion 5 on the heel-side.

In the upper extended wall part 9*a* and lower extended wall part 9*b* in this embodiment, the distance D is maximized in the vicinity of the vertical plane VP2 in the plan view as shown in FIG. 5, and the distance D gradually decreases towards the ends in both of a toe-side end portion and a heel-side end portion of each part 9*a,* 9*b.* In each of the extended wall parts 9*a* and 9*b,* the distance D is more than 5 mm in its major portion excepting the heel-side end portion. Of course, the distances D can be varied not only in each individual part 9*a,* 9*b,* 9*c* but also between the parts 9*a,* 9*b* and 9*c.*

Figure 3:
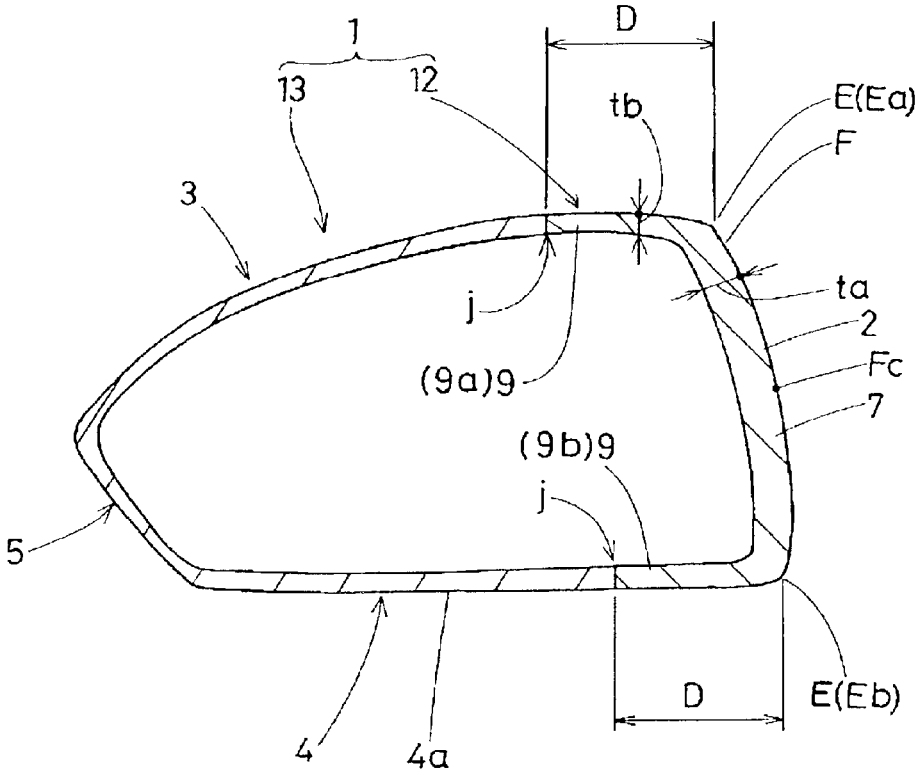
FIG. 3 is a cross sectional view of the club head.

In this example, as shown in FIG. 3, the thickness (ta) of the main portion 7 is increased to over the thickness (tb) of the extended wall part 9 to provide a sufficient strength for the face portion 2. The thickness of the main portion 9 is usually set in a range of from 1.5 to 3.0 mm. The thickness (tb) of the extended wall part 9 is set to be substantially equal to that of the respective major parts 14, 15 and 16 at the front end. The ratio of the average thickness (ta) to the average thickness (tb) is preferably set in a range of 1.0 to 4.0. Thereby, the rebound performance can be further improved without lowering the strength of the club head.

Comparison Tests

Golf club heads were experimentally made and tested as follows.

The face members were formed by hot forging. The materials used were: an alpha-beta-type titanium alloy (SP700, NKK corporation in Japan) whose transformation temperature to the beta phase was 890° C.; and an alpha-beta-type titanium alloy (Ti-6Al -4V) whose transformation temperature to the beta phase was 990° C. The forging temperature for SP700 was 840° C., and the forging temperature for Ti-6Al-4V was 930° C.

The face members were combined with main bodies which were identical with each other. The main body was formed as a precision casting of an alpha-beta-type titanium alloy Ti-6Al-4V using a lost-wax process. The face member was welded to the main body by tungsten-inert gas welding.

Vickers Hardness Test

According to the Japanese Industrial Standard JIS-Z2244, "Method of Vickers Hardness Test", the clubface was measured using a microhardness testing machine "HMV-2000" manufactured by Shimadzu Corporation. The load was 50 gf and the time for which the load of 50 gf was applied was ten seconds.

The results are shown in Table 1, wherein each value is an average of measurements at five measuring positions set within a circle of 5 mm radius centered on the face center Fc.

Hit Feel and Hitting Sound Test

Wood-type golf clubs were made by combining the club heads with identical fiber reinforced plastic shafts. From a comprehensive standpoint, hit feel and hitting sound were evaluated by ten top-level amateur golfers. The results are shown in Table 1, wherein: "A" indicates that seven or more golfers judged to be "good"; "B" indicates that from four to six golfers judged to be "good"; and "X" indicates other than those above.

Strength Test

Each golf club was attached to a swing robot and hit two-piece balls 5,000 times. The head speed was 50 m/sec.

The results are shown in Table 1, wherein: "A" indicates that the clubface was broken after hitting 5,000 times; "B" indicates that the clubface was broken in a range of not less than 3,000 times but less than 5,000 times; and "X" indicates that the clubface was broken under 3,000 times.

Rebound Performance Test

According to the "Procedure for Measuring the Velocity Ratio of a Club Head for Conformance to Rule 4-1e, Appendix II, Revision 2 (Feb. 8, 1999), United States Golf Association.", the restitution coefficient "e" was obtained using the following equation:

$$Vo/Vi=(eM-m)/(M+m)$$

wherein

Vo: ball rebound velocity

Vi: ball incoming velocity

M: the mass of the club head m: the mass of the ball.

As specified therein, the golf balls used were "Titleist, PINNACLE GOLD" and the radius of the target circle centered on the sweet spot was 5 mm. The distance between the clubface and the launching device was 55 inches, and the incoming ball velocity was 160±0.5 feet/sec.

The test results are shown in Table 1.

From the test results, it was confirmed that club heads according to the present invention can display good feel, rebound performance and strength.

TABLE 1

| Club head | Ex. 1 | Ex. 2 | Ex. 3 | Ex. 4 | Ref. 1 | Ref. 2 | Ref. 3 | Ref. 4 | Ref. 5 | Ref. 6 |
|---|---|---|---|---|---|---|---|---|---|---|
| Face member | | | | | | | | | | |
| Material | SP700 | SP700 | SP700 | Ti-6Al-4V | Ti-6Al-4V | SP700 | SP700 | SP700 | SP700 | SP700 |
| Forging temperature (° C.) | 840 | 800 | 880 | 940 | 940 | 840 | 840 | 840 | 840 | 900 |
| Cooling | *1 | *1 | *1 | *1 | *2 | *3 | *2 | *1 | *1 | *1 |
| Distance D | | | | | | | | | | |
| Max. of D (mm) | 8 | 8 | 8 | 8 | 8 | 8 | 8 | 3 | 0 | 8 |
| Percentage of edge length at which D was at least 5 mm | 60 | 50 | 70 | 40 | 60 | 60 | 60 | 0 | 0 | 60 |
| Test results | | | | | | | | | | |
| Vickers hardness (Hv) | 327 | 310 | 350 | 326 | 319 | 390 | 324 | 290 | 329 | 387 |

TABLE 1-continued

| Club head | Ex. 1 | Ex. 2 | Ex. 3 | Ex. 4 | Ref. 1 | Ref. 2 | Ref. 3 | Ref. 4 | Ref. 5 | Ref. 6 |
|---|---|---|---|---|---|---|---|---|---|---|
| Hitting | A | A | A | A | A | X | A | X | B | B |
| Strength | A | A | A | A | X | X | X | A | B | X |
| Restitution coefficient | 0.841 | 0.837 | 0.843 | 0.836 | 0.835 | 0.838 | 0.839 | 0.840 | 0.832 | 0.839 |

*1 Average cooling rate: 2 deg. C./sec (Air cooling without blower, ambient temperature 20 deg. C.)
*2 Average cooling rate: 20 deg. C./sec (Water-cooling)
*3 Average cooling rate: 1 deg. C./sec (Slow cooling)

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A wood-type golf club head having a volume of not less than 300 cc, which comprises a main body and a face member disposed at the front of the main body to form a clubface, said face member formed by (i) forging an alpha-beta-type titanium alloy at a temperature which is less than the transformation temperature to the beta phase of the alloy, said temperature being not more than 100° C. less than said transformation temperature, and (ii) subsequent slow air cooling made without a blower within a temperature range of from 0 to 100° C., wherein, the face member is welded to the main body to form a junction therebetween, at least a part of said junction shifted backwards from the edge of the clubface by at least 5 mm, and the total length of the edge of the clubface where the extension is at least 5 mm is not less than 40% of the entire length of the edge, wherein the clubface F has a Vickers hardness in a range of from 300 to 380 Hv when measured according to Japanese Industrial Standard JIS-Z2244 with a load of 50 gf and a load duration time of ten seconds.

2. The wood-type golf club head according to claim 1, wherein the total length of the edge is not less than 50%.

3. The wood-type golf club head according to claim 1, wherein the total length of the edge is not less than 60%.

4. The wood-type golf club head according to claim 1, wherein the edge of the clubface at which the junction is at least 5 mm covers the entirety of the edge of the club face excepting a part near a hosel.

5. The wood-type golf club head according to claim 1, wherein the face member is composed of a substantially flat main portion of which outer surface defines the clubface, and a wall portion extending backward from the edge of the clubface, and the main portion is thicker than the wall portion.

6. The wood-type golf club head according to claim 5, wherein the thickness of the main portion is in a range of from 1.5 to 3.0 mm.

7. The wood-type golf club head according to claim 5, wherein the ratio of the average thickness of the main portion to the average distance of the extended wall portion is in the range of 1.0 to 4.0.

8. The wood-type golf club head according to claim 1, wherein the alpha-beta-type titanium alloy is selected from the group consisting of Ti-6Al-4V, Ti-4.5Al-3V-2Fe-2Mo and Ti-3Al-2.5V.

9. The wood-type golf club head according to claim 1, wherein the main body is an integral molding of an alpha-beta-type titanium alloy formed by lost-wax precision casting.

10. The wood-type golf club head of claim 1, wherein the air cooling is conducted at a temperature range of from 10 to 50° C.

11. The wood-type golf club head of claim 1, wherein the face member is composed of a substantially flat main portion of which the outer surface defines the clubface, and a wall portion extends backward from an upper edge of the clubface.

12. The wood-type golf club head of claim 1, wherein the face member is composed of a substantially flat main portion of which the outer surface defines the clubface, and a wall portion extending backward from a lower edge of the clubface.

13. The wood-type golf club head of claim 1, wherein the face member is composed of a substantially flat main portion of which the outer surface defines the clubface, and a wall portion extending backward from both an upper edge and a lower edge of the clubface.

14. A wood-type golf club head which comprises a main body; and a face member disposed at the front of the main body to form a clubface, said face member being formed from an alpha-beta-type titanium alloy and attached to the main body to form a junction therebetween, at least a part of said junction shifted backwards from the edge of the clubface by at least 5 mm, and the total length of the edge of the clubface where the extension is at least 5 mm is not less than 40% of the entire length of the edge and said clubface having a Vickers hardness in a range of from 300 to 380 Hv when measured according to Japanese Industrial Standard JIS-Z2244 with a load of 50 gf and a load duration time of ten seconds.

* * * * *